US008382104B2

(12) United States Patent
Yasumoto

(10) Patent No.: US 8,382,104 B2
(45) Date of Patent: Feb. 26, 2013

(54) IMAGE FORMING APPARATUS AND CONTROL METHOD THEREFOR

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/766,182

(22) Filed: Apr. 23, 2010

(65) Prior Publication Data

US 2010/0283199 A1 Nov. 11, 2010

(30) Foreign Application Priority Data

May 8, 2009 (JP) ..... 2009-113539

(51) Int. Cl.
*B65H 9/16* (2006.01)

(52) U.S. Cl. ..... 271/251; 271/248; 271/249; 271/250; 271/228

(58) Field of Classification Search ..... 271/248–252, 271/227, 228
See application file for complete search history.

(56) References Cited

U.S. PATENT DOCUMENTS 6,273,418 B1 * 8/2001 Fujikura et al. ..... 271/228
6,324,377 B2 * 11/2001 Ando et al. ..... 399/395
7,121,545 B2 * 10/2006 Baumgarten et al. ..... 271/250
7,469,894 B2 * 12/2008 Seto ..... 271/238
7,658,379 B2 * 2/2010 Yasumoto ..... 271/251
2008/0054553 A1 * 3/2008 Muneyasu et al. ..... 271/240
2009/0033030 A1 2/2009 Yasumoto
2009/0091075 A1 * 4/2009 Yasumoto ..... 271/250
2009/0134569 A1 * 5/2009 Matsui ..... 271/227
2010/0158568 A1 6/2010 Yasumoto
2010/0158585 A1 6/2010 Yasumoto
2010/0296854 A1 * 11/2010 Otsuki et al. ..... 400/582

FOREIGN PATENT DOCUMENTS

JP 2002-356250 A 12/2002
JP 2005112543 A * 4/2005

* cited by examiner

*Primary Examiner* — Luis A Gonzalez
(74) *Attorney, Agent, or Firm* — Fitzpatrick, Cella, Harper & Scinto

(57) ABSTRACT

An image forming apparatus that is capable of reducing a jam and correcting misalignment of a sheet due to a buckling of the sheet certainly. A skew correction unit conveys a sheet while contacting one of side edges of the sheet with a reference member that is arranged in parallel to a conveyance direction in order to correct a skew of the sheet conveyed along a conveyance path. A misalignment correction unit moves the sheet that the skew has been corrected in a width direction perpendicular to the conveyance direction. A sheet position detection unit detects a position of the other of the side edges of the sheet that the skew has been corrected. A moving amount determination unit determines a moving amount by which the misalignment correction unit moves the sheet in the width direction.

5 Claims, 9 Drawing Sheets

IMAGE FORMING APPARATUS AND CONTROL METHOD THEREFOR

BACKGROUND OF THE INVENTION

1. Field of the Invention

The present invention relates to an image forming apparatus and a control method therefor that are able to correct skew and misalignment of a sheet conveyed along a conveyance path.

2. Description of the Related Art

When a sheet (transfer material) skews or misaligns during conveyance of the sheet in an image forming apparatus, a conveyance jam (sheet jam) and a sheet handling error with respect to an accessory device will arise. Skew or misalignment of a sheet decreases an accuracy of alignment between the sheet and an image. For example, a position of the image transferred is misaligned with respect to the sheet. Therefore, the image forming apparatus is provided with a mechanism that corrects skew and misalignment of a sheet at just before a position at which an image is transferred to the sheet in order to improve the accuracy of alignment between the sheet and the image.

There are various methods to correct skew and misalignment. For example, there are a diagonal feeding registration method, a no-contact method, etc.

The diagonal feeding registration method uses a skew roller that is arranged to be inclined by a predetermined angle with respect to a conveyance direction, and a contact reference member with which a side edge of a sheet contacts. A sheet is conveyed as a side edge of the sheet contacts with the contact reference member by a conveyance component in the direction perpendicular to the conveyance direction caused by the diagonal feeding roller. Accordingly, a skew correction of the sheet is performed without stopping the conveyance of the sheet. Therefore, the diagonal feeding registration method is advantageous to improve productivity of the image forming apparatus. Since the method that performs skew correction by contacting the side edge of the sheet with the contact reference member is simple, it has an advantage of not needing complicated control.

Many image forming apparatuses adopt configurations to turn upside down a sheet by switching back the sheet after an image is formed on one surface of the sheet when forming images on the both surfaces of the sheet. When using the diagonal feeding registration method in the image forming apparatus that adopts such a configuration, the sheet reversed by a switchback turnover is conveyed while the side edge contacts with the contact reference member similarly. Therefore, a reference of the skew correction to the sheet reversed by the switchback turnover is identical to that to the sheet before the switchback turnover (front and end edges are interchanged by the switchback turnover). Accordingly, there is also an advantage that increases relative registration accuracy in both surfaces of a sheet.

On the other hand, in the diagonal feeding registration method, when a side edge of a sheet contacts with the contact reference member, too strong force that pushes the sheet to the contact reference member may cause a buckling and a loop of the sheet. Then, a guide groove into which a side edge of a sheet is inserted is formed on the contact reference member in order to reduce a buckling and a loop of the sheet by keeping the sheet from the upper and lower sides.

However, since the width of the guide groove of the contact reference member is determined on the basis of the maximum thickness of sheets that can be conveyed, the width is too large to hold a low stiffness sheet (a soft sheet) such as a thin sheet, which causes a buckling or a loop of the sheet. The buckling of a sheet occurs similarly when an amount of curl of a side edge of a sheet is large. Thus, when the buckling occurs, the skew correction is not performed normally and alignment between a sheet and an image cannot be performed in a high precision because of, for example, misalignment of the image with respect to the sheet. As a result, quality of a printed sheet decreases sharply.

A sheet conveyance device with a sheet correction unit that prevents a sheet from buckling when the sheet contacts with the contact reference member is proposed (see Japanese laid-open patent publication (Kokai) No. 2002-356250 (JP2002-356250A)). The sheet correction unit of this sheet conveyance device will be described with reference to FIG. 10. FIG. 10 is a longitudinal sectional view schematically showing a configuration of principal part of the sheet correction unit of the conventional sheet conveyance device.

As shown in FIG. 10, the sheet correction unit of the above-mentioned conveyance device is provided with a side reference guide 80 with which a side edge of a sheet S contacts, a skew roller 81 that aligns the sheet S to the side of the side reference guide 80, and a driven roller 82. The driven roller 82 cooperates with the skew roller 81 to form a nip for holding and conveying a sheet. The side reference guide 80 is arranged adjacent to upper and lower guide members 83 that form a sheet conveyance path. The side reference guide 80 consists of a fixed part 80*a* and a movable part 80*b*. The fixed part 80*a* and the movable part 80*b* cooperate to form a guide groove into which the side edge of the sheet S is inserted. The movable part 80*b* always contacts with a cam surface of an adjustment cam 86 that is attached to an output shaft of a motor 85 with a spring 84. The movable part 80*b* moves in a direction shown by an arrow in FIG. 10 along the fixed part 80*a* by rotation of the adjustment cam 86. As a result, the width (conveyance gap) of the above-mentioned guide groove is adjusted according to thickness of a sheet etc.

However, since the above-mentioned sheet correction unit adjusts the conveyance gap so that the gap becomes small as the thickness of the sheet decreases, the sheet tends to contact both of the fixed part 80*a* and the movable part 80*b* of the guide 80, which increases conveyance friction when the sheet passes through the guide groove. The smaller the conveyance gap is, the smaller the spatial capacity of the guide groove for holding an end edge of a sheet is, when the sheet is received from a conveyance path that is upstream from the guide 80. Accordingly, there is a high possibility that a jam occurs. In order to make the movable part 80*b* move against the fixed part 80*a*, a gap is generated between the movable part 80*b* and the fixed part 80*a*. When a side edge of the sheet S is inserted into the gap, a jam may occur.

Thus, the method of adjusting the conveyance gap according to a thickness of a sheet tends to generate a jam instead of reducing a buckling.

SUMMARY OF THE INVENTION

The present invention provides an image forming apparatus and a control method therefor that are capable of reducing a jam and of correcting misalignment of a sheet due to a buckling of the sheet certainly by a skew correction unit that corrects a skew of a sheet.

Accordingly, a first aspect of the present invention provides an image forming apparatus comprising a skew correction unit adapted to convey a sheet while contacting one of side edges of the sheet with a reference member that is arranged in parallel to a conveyance direction in order to correct a skew of the sheet conveyed along a conveyance path, a misalignment correction unit adapted to move the sheet that the skew has been corrected by the skew correction unit in a width direction perpendicular to the conveyance direction, a sheet position detection unit adapted to detect a position of the other of the side edges of the sheet that the skew has been corrected by the skew correction unit, and a moving amount determination unit adapted to determine a moving amount by which the misalignment correction unit moves the sheet in the width direction based on a difference between the position of the other of the side edges of the sheet detected by the sheet position detection unit and a specified position determined according to a length of the sheet in the width direction.

Accordingly, a second aspect of the present invention provides a control method for an image forming apparatus that is provided with a skew correction unit for conveying a sheet while contacting one of side edges of the sheet with a reference member that is arranged in parallel to a conveyance direction in order to correct a skew of the sheet conveyed along a conveyance path, and a misalignment correction unit for moving the sheet that the skew has been corrected by the skew correction unit in a width direction perpendicular to the conveyance direction, the control method comprising a step of detecting a position of the other of the side edges of the sheet that the skew has been corrected by the skew correction unit, and a step of determining a moving amount by which the misalignment correction unit moves the sheet in the width direction based on a difference between the position of the other of the side edges of the sheet detected and a specified position determined according to a length of the sheet in the width direction.

According to the present invention, a jam can be reduced by the skew correction unit, and misalignment of a sheet due to a buckling of a sheet can be corrected certainly.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
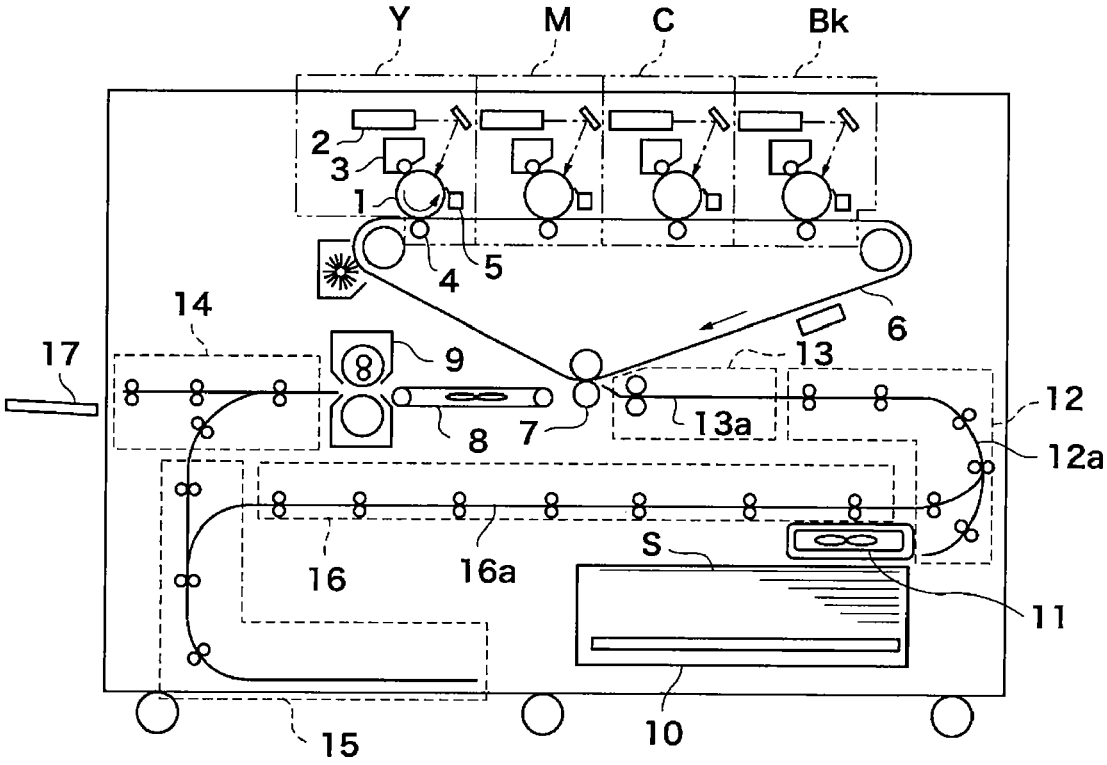
FIG. 1 is a longitudinal sectional view schematically showing a configuration of an image forming apparatus according to an embodiment of the present invention.

FIG. 1 is a longitudinal sectional view schematically showing a configuration of an image forming apparatus according to an embodiment of the present invention. Here, the image forming apparatus of a tandem system that forms a color image using an electrophotography method will be described.

The image forming apparatus of this embodiment is provided with four image forming units Y, M, C, and Bk as shown in FIG. 1. The image forming units Y, M, C, and Bk form toner images of respective colors (yellow, magenta, cyan, and black) based on corresponding image signals.

The image forming unit Y is provided with a photosensitive drum 1 that rotates in a direction of the arrow in FIG. 1. Around the photosensitive drum 1, a laser exposure device 2, a development device 3, a primary transfer roller 4, and a cleaning device 5 are arranged.

The laser exposure device 2 modulates a laser beam based on an image signal. The laser exposure device 2 irradiates the photosensitive drum 1 with the modulated laser beam and scans the surface of the photosensitive drum 1 with the laser beam to expose. Accordingly, a latent image based on the image signal is formed on the surface of the photosensitive drum 1.

The development device 3 supplies toner of a color corresponding to the photosensitive drum 1 (here, yellow toner), and develops the latent image formed on the surface of the photosensitive drum 1 as a toner image of the corresponding color (here, yellow toner image).

The primary transfer roller 4 transfers the toner image formed on the surface of the photosensitive drum 1 to an intermediate transfer belt 6, and rotates following a movement of the intermediate transfer belt 6.

The cleaning device 5 has a cleaning blade to scrape the toner that remains on the photosensitive drum 1 after transferring the toner image, and collects the toner that is scraped by the cleaning blade from the photosensitive drum 1.

Since the other image forming units M, C, and Bk have the same configuration as the image forming unit Y, descriptions about the other image forming units are omitted.

Toner images formed by the image forming units Y, M, C, and Bk are transferred to the intermediate transfer belt 6 so as to overlap in order (a primary transfer). Accordingly, a full-color toner image is formed and supported on the intermediate transfer belt 6. The toner image supported by the intermediate transfer belt 6 is transferred by a secondary transfer roller 7 onto a sheet S that is fed to a position (a secondary transfer position) between the secondary transfer roller 7 and the intermediate transfer belt 6 (a secondary transfer). The sheet S on which the toner image has been transferred is conveyed to a fixing unit 9 by a conveyance belt 8. The fixing unit 9 heats and pressurizes the toner image on the sheet S, and fixes the toner image on the sheet S.

The sheet S on which the toner image has been fixed is sent to a branch conveying unit 14. The branch conveying unit 14 switches a conveyance path so that the sheet S is sent to a sheet output tray 17 or a reversal feeding unit 15.

The reversal feeding unit 15 turns upside down the sheet S by a switch back method that draws the sheet S sent from the branch conveying unit 14 and sends the sheet S to a double-sided conveying unit 16.

The double-sided conveying unit 16 has a sheet re-feeding path 16*a* for re-feeding the sheet S, and re-feeds the sheet S sent out from the reversal feeding unit 15 to a conveyance unit 12 via the sheet re-feeding path 16*a*.

The conveyance unit 12 has a conveyance path 12*a* that joins to the sheet re-feeding path 16*a* at a midpoint, and conveys the sheet S that is fed from a sheet cassette 10 or the sheet S that is re-fed through the re-feeding path 16*a* to a registration unit 13.

The registration unit 13 has a conveyance path 13*a* that joins the conveyance path 12*a* of the conveyance unit 12, and corrects skew and misalignment of the sheet S conveyed along the conveyance path 13*a*. The sheet S that is corrected in skew and misalignment is sent out to the above-mentioned secondary transfer position in synchronization with image formation timing.

The sheets S are stored in the sheet cassette 10, and these sheet S stored are fed from the sheet cassette 10 by a sheet feeding device 11. There are a friction separation method by a feeding roller etc. and an adsorptive separation method by air as a sheet feeding method of the sheet feeding device 11. In this example, the sheet feeding device 11 of the adsorptive separation method by air is used. The sheet S fed by the sheet feeding device 11 is sent to the conveyance unit 12.

Figure 2:
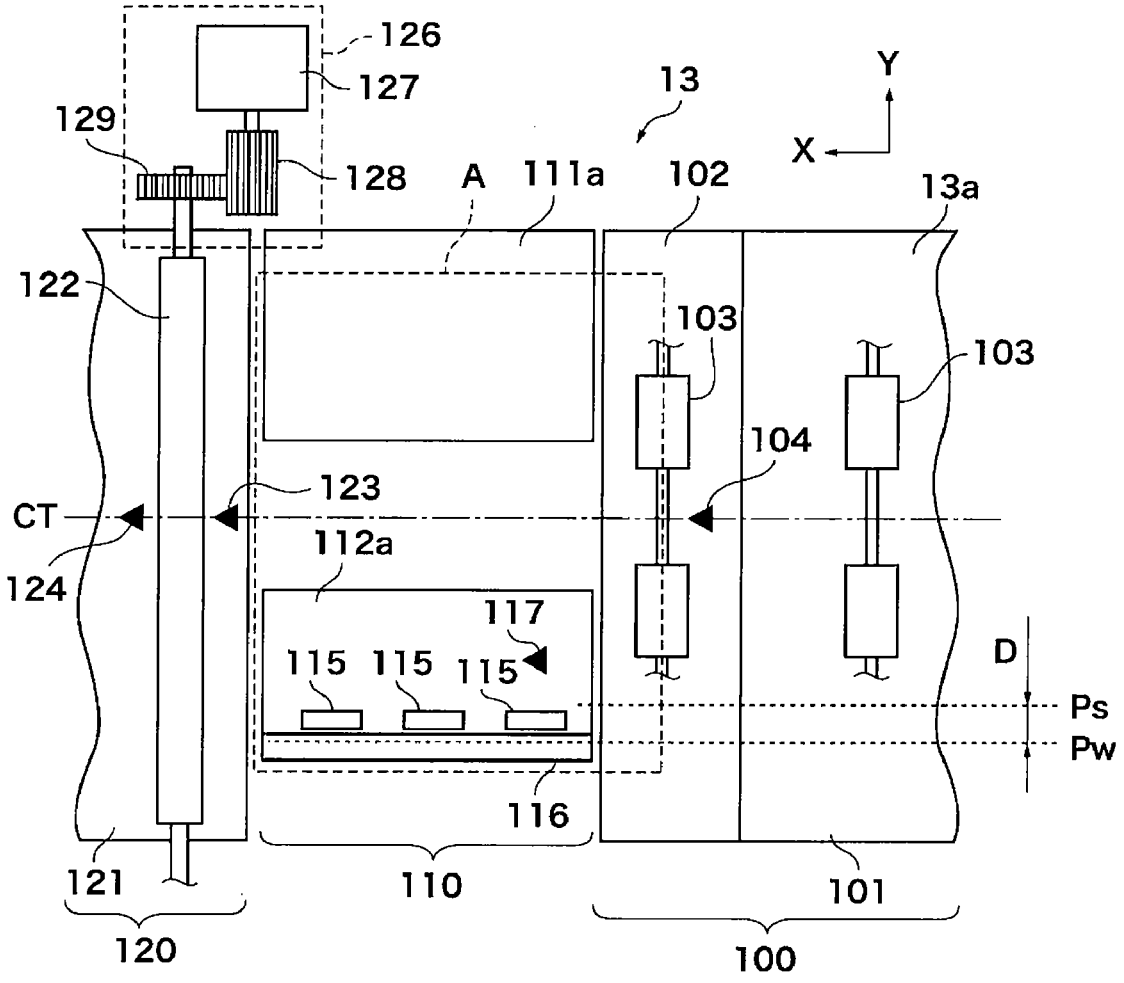
FIG. 2 is a top view schematically showing a configuration of a registration unit in FIG. 1.
Figure 3:
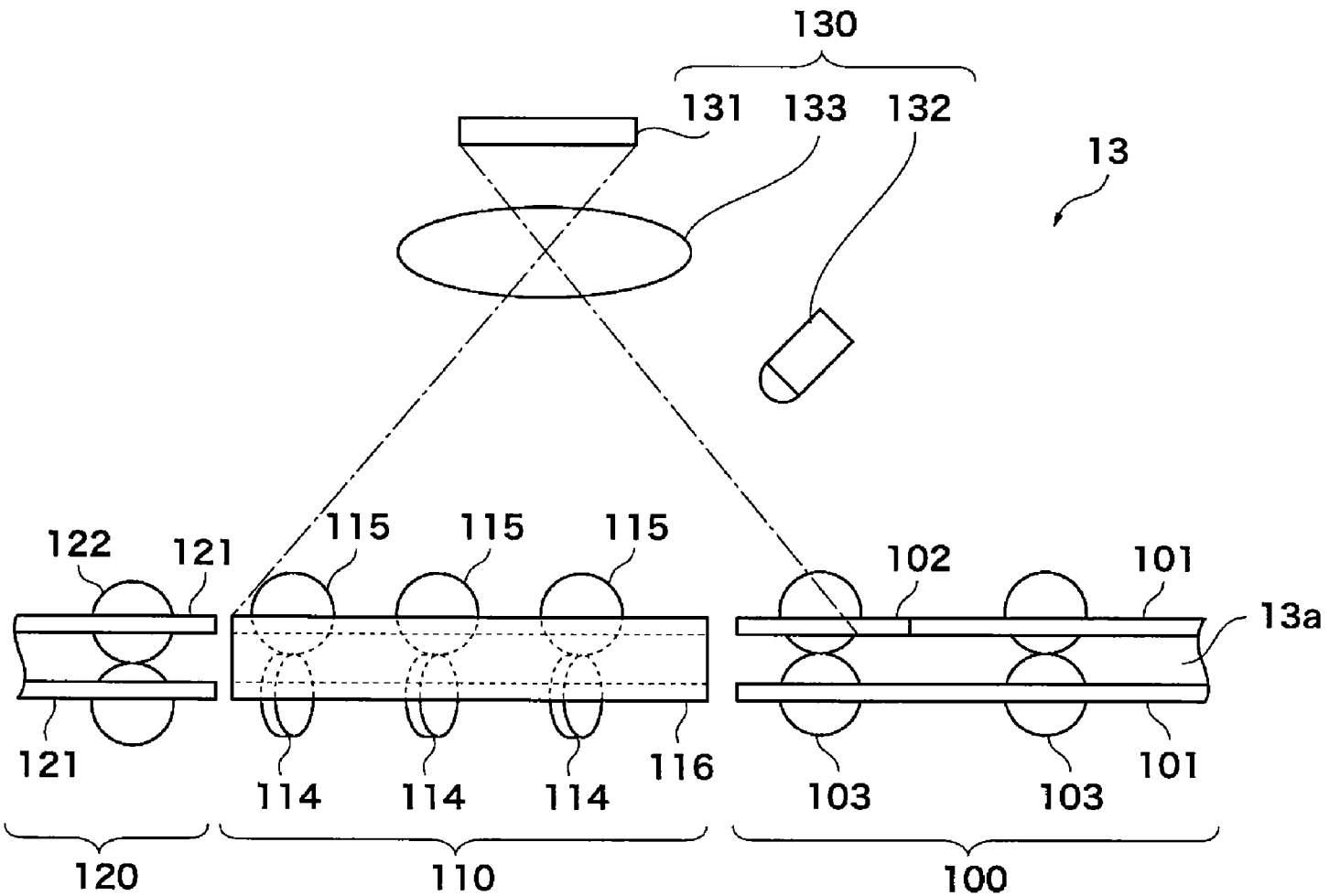
FIG. 3 is a side view showing the registration unit in FIG. 2.
Figure 4:
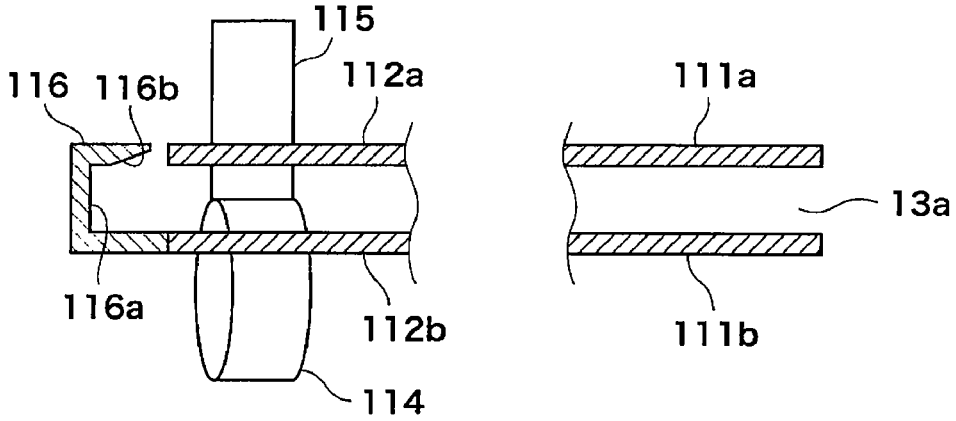
FIG. 4 is a sectional view showing a skew correction unit in FIG. 2 in a width direction.
Figure 5:
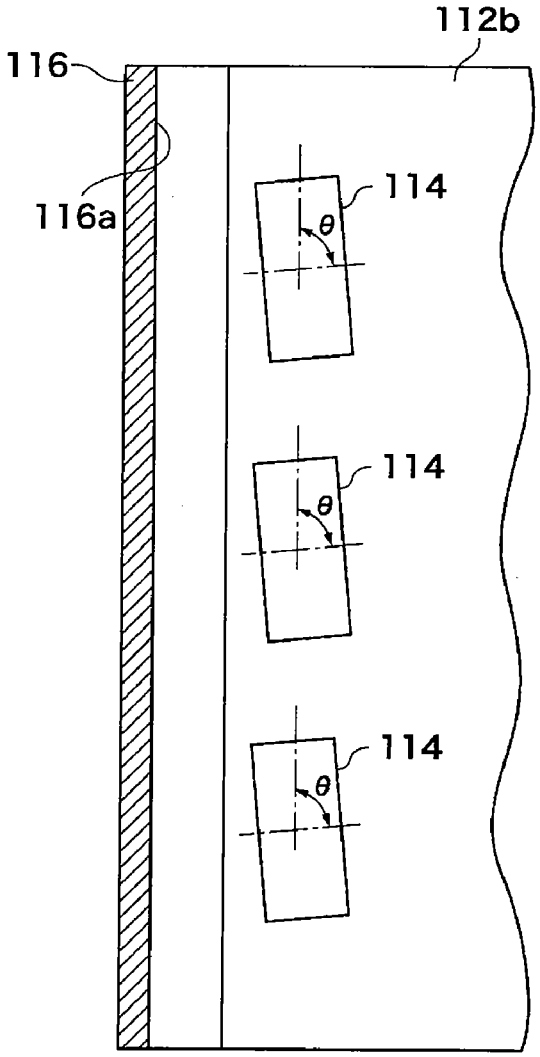
FIG. 5 is a top view showing an arrangement condition of diagonal feeding rollers of the skew correction unit in FIG. 2.

Next, a configuration of the above-mentioned registration unit 13 will be described with reference to FIG. 2 through FIG. 5. FIG. 2 is a top view schematically showing the configuration of the registration unit 13 in FIG. 1. FIG. 3 is a side view showing the registration unit 13 in FIG. 2. FIG. 4 is a sectional view showing a skew correction unit 110 in FIG. 2 in a width direction Y. FIG. 5 is a top view showing an arrangement condition of diagonal feeding rollers 114 of the skew correction unit 110 in FIG. 2.

In this embodiment, as mentioned above, the reversal feeding unit 15, which adopts the switch back method as a method to reverse the sheet S, is provided. In this switch back method, a front edge and an end edge of the sheet S are interchanged in a conveyance direction before and after the reversal of the sheet S. Thus, in this embodiment, a diagonal feeding registration method that uses a side edge (a left edge) of the sheet S, which does not change its position before and after the reversal, as a reference of a skew correction.

The registration unit 13 comprises a conveyance section 100, a skew correction section 110, and a misalignment correction section 120, as shown in FIG. 2 and FIG. 3. A pair of guide members 101 are provided in the conveyance section 100. The pair of guide members 101 cooperate to form a part of the conveyance path 13*a* that is connected with the conveyance path 12*a* of the conveyance unit 12 at the upstream side. A light transmission section 102 that is formed by replacing a part of the guide member 101 with a light transmission member is provided in the upper guide member 101. The light transmission section 102 is provided so as to face the conveying roller pair 103 of the most downstream position among a plurality of conveying roller pairs 103.

The conveying roller pairs 103 are driven to rotate so as to convey the sheet S conveyed from the conveyance unit 12 along the conveyance path 13*a* and to stop the sheet S once at the conveyance section 100 if needed. A conveying roller drive mechanism 204 shown in FIG. 6 drives to rotate each of the conveying roller pairs 103. This conveying roller drive mechanism 204 comprises a motor, a mechanism for transferring an output of the motor to each of the conveying roller pairs 103, a driver for driving the motor, etc. With respect to each of the conveying roller pairs 103, one conveying roller comes off the other conveying roller by a conveying roller release device 205 shown in FIG. 6 to release conveyance nip of the sheet S if needed. The conveying roller release device 205 comprises a motor, a mechanism for releasing the conveying roller pairs 103 by an output of the motor, a driver for driving the motor, etc.

A sheet sensor 104 for detecting the front edge of the sheet S is provided in the conveyance section 100. The sheet sensor 104 is arranged at an entrance position that is a slightly upstream position of the conveying roller pair 103 located at the most downstream position among a plurality of conveying roller pairs 103. When detecting that the front edge of the sheet S passes the position of the sheet sensor 104 (the entrance position of the conveying roller pairs 103), the sheet sensor 104 outputs a detection signal.

When the above-mentioned detection signal is outputted from the sheet sensor 104, the sheet S is stopped at the conveyance section 100. The stop of the sheet S is for canceling a gap of the conveyance timing of the sheet S to be conveyed. In the skew correction section 110 mentioned below, two conveyance forces in a conveyance direction X of the sheet S and in a width direction Y perpendicular thereto act on the sheet S by the diagonal feeding rollers 114. The sheet S after the contact to a contact reference member 116 is conveyed with slipping. Accordingly, the variation in the conveyance timing of the sheet S becomes comparatively large. Therefore, the conveyance timing of the sheet S is reset by stopping the sheet S once by the conveyance section 100.

The skew correction section 110 has a pair of fixed guide members 111*a* and 111*b*, and a pair of movable guide members 112*a* and 112*b*. The fixed guide members 111*a* and 111*b* and the movable guide members 112*a* and 112*b* cooperate to form a part of the conveyance path 13*a*. Here, the fixed guide member 111*a* and the movable guide member 112*a* are made of light transmission material.

The plurality of diagonal feeding rollers 114 and a plurality of driven rollers 115, the contact reference member 116, and a sheet sensor 117 are mounted on the skew correction section 110.

The diagonal feeding rollers 114 are arranged in the conveyance direction X as shown in FIG. 5. The diagonal feeding rollers 114 are arranged so that axes are inclined with respect to the conveyance direction X of the sheet S by a predetermined angle θ. The diagonal feeding rollers 114 contact the corresponding driven rollers 115 as shown in FIG. 3 and FIG. 4, and the conveyance nips for conveying the sheet S are formed between the diagonal feeding rollers 114 and the corresponding driven rollers 115. When conveying the sheet S by the diagonal feeding rollers 114, the two conveyance forces in the conveyance direction X and in the width direction X of the sheet S act on the sheet S. The diagonal feeding rollers 114 is individually driven to rotate by a diagonal feeding roller drive mechanism 206 shown in FIG. 6. The incline angles θ of the axes of the diagonal feeding rollers 114 are individually adjusted by a diagonal-feeding-roller-skew-angle adjustment mechanism 207 shown in FIG. 6. Contact pressures to the diagonal feeding rollers 114 by the corresponding driven roller 115 are individually adjusted by a diagonal feeding roller contact mechanism 208 shown in FIG. 6. The diagonal feeding roller contact mechanism is possible to release the diagonal feeding rollers 114 from the driven rollers 115.

The above-mentioned diagonal feeding roller drive mechanism 206 includes motors that are provided for the respective diagonal feeding rollers 114, drivers therefor, and mechanisms that drive to rotate the corresponding diagonal feeding rollers 114 by outputs of the motors, respectively. The above-mentioned diagonal-feeding-roller-skew-angle adjustment mechanism 207 includes motors that are provided for the respective diagonal feeding rollers 114, drivers therefor, and mechanisms that rotate the corresponding diagonal feeding rollers 114 about axes perpendicular to the conveyance direction X by outputs of the motors, respectively. The diagonal feeding roller contact mechanism 208 includes motors that are provided for the respective driven rollers 115, drivers therefor, and mechanisms that push the driven rollers 115 to contact with the corresponding diagonal feeding roller 114 due to predetermined pressing force and that release them by outputs of the motors, respectively.

The contact reference member 116 has a grooved cross sectional shape into which one side edge (a left edge) of the sheet S can be inserted as shown in FIG. 4. The contact reference member 116 has a contact surface 116*a* to which the left edge of the sheet S contacts. A taper section 116*b* for receiving the sheet S smoothly is formed in the contact reference member 116. The contact reference member 116 is connected to the movable guide member 112*b* so as to take in the left edge of the sheet S and to make the contact surface 116*a* be in parallel with the conveyance direction X.

The sheet sensor 117 is arranged in the vicinity of the driven roller 115 (the diagonal feeding roller 114) at the most upstream position among the driven rollers 115 (the diagonal feeding rollers 114). When detecting that the front edge of the sheet S passes the position of the sheet sensor 117, the sheet sensor 117 outputs a detection signal. The above-mentioned detection signal of this sheet sensor 117 is used as a signal that instructs a release operation of the conveying roller pairs 103 as described below.

Here, the movable guide members 112*a* and 112*b*, the diagonal feeding rollers 114, the driven rollers 115, the contact reference member 116, and the sheet sensor 117 are united and are constituted as a movable unit that is movable in the width direction Y. Movement of the above-mentioned movable unit in the width direction Y is performed by a movable unit movement mechanism 209 shown in FIG. 6. The movable unit movement mechanism 209 includes a motor, a driver therefor, and a mechanism that moves the above-mentioned movable unit in the width direction Y.

The misalignment correction section 120 has a pair of conveyance guide members 121, a registration roller pair 122, and two sheet sensors 123 and 124. The conveyance guide members 121 cooperate to form a part of the conveyance path 13*a*.

The registration roller pair 122 is driven to rotate by a registration roller drive mechanism 126. The registration roller drive mechanism 126 has a motor 127. A gear 128 is fixed to an output shaft of the motor 127, and the gear 128 engages a gear 129 that is fixed to a shaft of the registration roller pair 122. One of the registration roller pair 122 can come off from the other by a registration roller release mechanism 210 shown in FIG. 6. The registration roller pair 122, the registration roller drive mechanism 126, and the above-mentioned registration roller release mechanism 210 are movable in the width direction Y as one unit by a registration roller movement mechanism 211 shown in FIG. 6.

The sheet sensor 123 is arranged at an entrance side of the registration roller pair 122 in a center position of the conveyance path 13*a*. The sheet sensor 123 outputs a detection signal when the front edge of the sheet S passes the sheet sensor 123 concerned. The sheet sensor 124 is arranged at an exit side of the registration roller pair 122 in a center position of the conveyance path 125. The sheet sensor 124 outputs a detection signal when the front edge of the sheet S passes the sheet sensor 124 concerned.

A skew sensor 130 for detecting a skew condition of the sheet S that enters the skew correction section 110 is provided in the registration unit 13. The skew sensor 130 has an image pickup device 131, a light source 132, and a lens 133. The image pickup device 131 such as a CMOS or a CCD is arranged in an upper position of the above-mentioned skew correction section 110. The image pickup device 131 picks up an image in an image pickup area A that is a conveyance area including the skew correction section 110 and a part of the conveyance section 100 of the conveyance path 13*a*. The light source 132 illuminates the above-mentioned image pickup area A at least. The reflected light passes through the fixed guide member 111*a* and the movable guide member 112*a*, and reaches the lens 133. The lens 133 forms an optical image by the reflected light from the above-mentioned image pickup area A on an image pickup surface of the above-mentioned image pickup device 131.

In the registration unit 13 that has such a configuration, a sheet conveyance reference position CT that specifies a center position of the sheet S in the width direction when the sheet S is conveyed is set up. The sheet conveyance reference position CT is in agreement with the center position of the conveyance paths 12*a* and 13*a*, and is the same position as an image reference position. This image reference position is a position of an image transferred to the sheet S at the above-mentioned secondary transfer position.

As shown in FIG. 2, the movable unit of the skew correction section 110 is moved so that the contact surface 116*a* of the contact reference member 116 is located at a standby position Pw corresponding to the size of the sheet S conveyed. The standby position Pw is specified by adding a contact margin D to a left edge position Ps corresponding to a length in the width direction Y that is defined by a nominal size of the sheet S with respect to the sheet conveyance reference position CT. Although the sheet S is conveyed with respect to the sheet conveyance reference position CT, the position of the sheet S is deviated in the width direction Y during conveyance. This misalignment may cause a collision of the sheet S with the contact reference member 116 when the sheet S enters the skew correction section 110. In order to avoid this, the standby position Pw is specified by adding the contact margin D to the left edge position Ps of the sheet S as mentioned above. Therefore, the position of the sheet S of which skew is corrected by contacting the contact reference member 116 is deviated by the contact margin D with respect to the sheet conveyance reference position CT.

Figure 6:
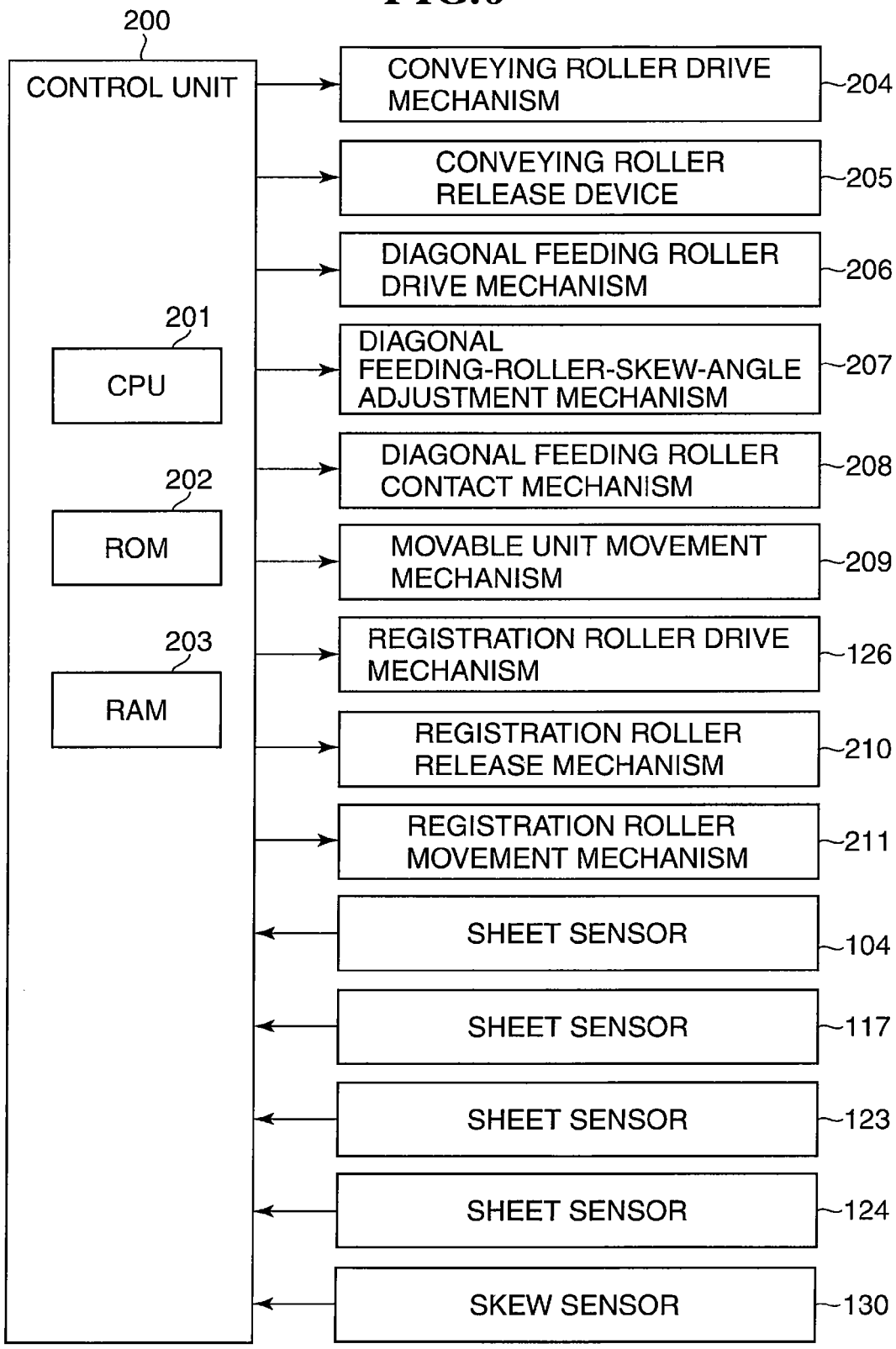
FIG. 6 is a block diagram schematically showing a control unit for controlling the registration unit in FIG. 1.

Next, a configuration for controlling the registration unit 13 will be described with reference to FIG. 6. FIG. 6 is a block diagram schematically showing a control unit for controlling the registration unit 13 in FIG. 1.

The registration unit 13 is controlled by a control unit 200 as shown in FIG. 6. The control unit 200 has a CPU 201, a ROM 202, and a RAM 203. The CPU 201 controls the registration unit 13 according to programs and data stored in the ROM 202. The RAM 203 provides a working area used when the CPU 201 controls the registration unit 13. Although the control unit 200 controls the entire system of the image forming apparatus, the image forming units Y, M, C, Bk, the fixing unit 9, etc., in addition to the control for the registration unit 13, the control configuration to these is omitted.

The sheet sensors 104, 117, 123, 124 and the skew sensor 130 that are provided in the registration unit 13 are connected to the control unit 200, which takes in the outputs of the sensors.

The control unit 200 controls the conveying roller drive mechanism 204, the conveying roller release mechanism 205, the diagonal feeding roller drive mechanism 206, the diagonal-feeding-roller-skew-angle adjustment mechanism 207, the diagonal feeding roller contact mechanism 208, and the movable unit movement mechanism 209. Moreover, the control unit 200 controls the registration roller drive mechanism 126, the registration roller release mechanism 210, and the registration roller movement mechanism 211.

Here, when the control unit 200 corrects skew and misalignment of the sheet S, it performs various processes including a squareness detection process, a sheet skew angle detection process, a control parameter varying process, a sheet position detection process, and a moving amount determination process.

In the above-mentioned squareness detection process, an angle formed between the front edge and the left edge of the sheet S is detected as squareness $\alpha$ based on an image of the sheet S (an image of the sheet S in the image pickup area A) that is picked up by the image pickup device 131.

In the above-mentioned sheet skew angle detection process, an angle of the front edge of the sheet S with respect to the conveyance direction X is detected as a skew angle $\beta$ of the sheet S based on the image of the sheet S that is picked up by the image pickup device 131.

In the above-mentioned control parameter varying process, a change rate R' of the skew angle $\beta$ of the detected sheet S is computed ($R'=\Delta\beta/\Delta t$), and values of parameters P1, P2, and P3 are changed so that the change rate R' of the skew angle $\beta$ approaches a target change rate R that is stored beforehand. Here, the control parameters P1, P2, and P3 are used for controlling a skew correction operation for the sheet S by the diagonal feeding rollers 114. The control parameter P1 is used for controlling the conveyance nip pressure of the diagonal feeding rollers 114. The control parameter P2 is used for controlling the skew angle $\theta$ of the axes of the diagonal feeding rollers 114. The control parameter P3 is used for controlling the conveyance speed of the diagonal feeding rollers 114. The values according to the thickness of the sheet (for example, a thin sheet with low stiffness or a thick sheet with high stiffness) are set to these control parameters P1 through P3.

The sheet position detection process is performed to the sheet S of which the detected skew angle $\beta$ is coincident with the squareness $\alpha$ thereof, i.e., to the sheet S of which the skew has been corrected. In this sheet position detection process, a position of the other side edge (the right edge, here) of the sheet S of which the skew has been corrected is detected with respect to the position of the contact surface 116*a* of the contact reference member 116 based on the image of the sheet S picked up by the image pickup device 131. It should be noted that the squareness $\alpha$ is not necessary to be detected, when the variation of the squareness $\alpha$ of the sheet S is negligible. In this case, it is enough to determine whether the skew angle $\beta$ is equal to 90 degrees. Namely, it is enough to determine whether the skew of the front edge of the sheet S becomes perpendicular to the conveyance direction.

In the moving amount determination process, a length between the position of the contact surface 116*a* of the contact reference member 116 and the position of the right side edge of the detected sheet S in the width direction Y is computed. The moving amount of the registration roller pair 122 of the misalignment correction section 120 is determined based on a difference between the computed length and the length of the sheet S in the width direction Y. That is, the moving amount of the sheet S that is moved by the registration roller pair 122 in the width direction Y is determined. The length of the sheet S in the width direction Y is a length specified by the nominal size of the sheet S.

The correction of skew and misalignment of the sheet S will be specifically described with reference to FIG. 7A, FIG. 7B, FIG. 7C, FIG. 7D, FIG. 8A, and FIG. 8B. FIG. 7A, FIG. 7B, FIG. 7C, and FIG. 7D are views schematically showing conditions when the registration unit 13 in FIG. 2 corrects skew and misalignment of the sheet S. FIG. 8A and FIG. 8B are views showing a condition where a neighborhood of the left edge of the sheet S that contacts with the contact surface 116*a* of the contact reference member 116 buckles.

Figure 7A:
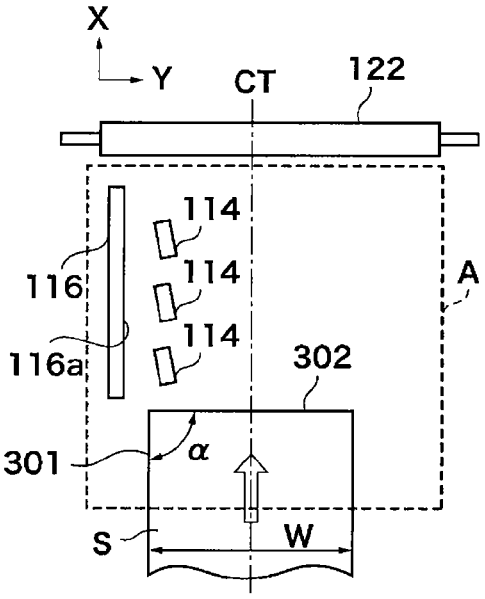
FIG. 7A, FIG. 7B, FIG. 7C, and FIG. 7D are views schematically showing conditions when the registration unit in FIG. 2 corrects skew and misalignment of a sheet.
Figure 8A:
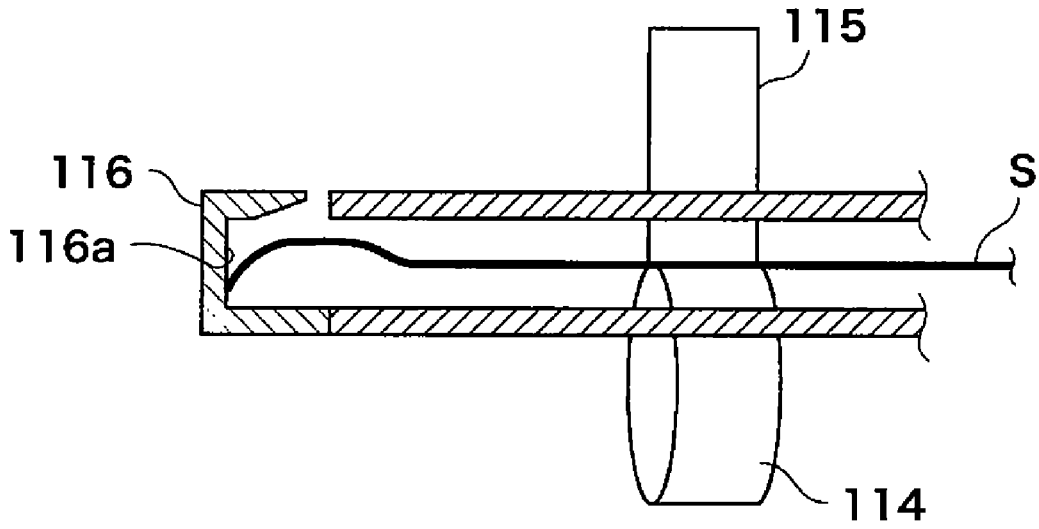
FIG. 8A and FIG. 8B are views showing a condition where a neighborhood of a left edge of a sheet that contacts with a contact surface of a contact reference member buckles.
Figure 8B:
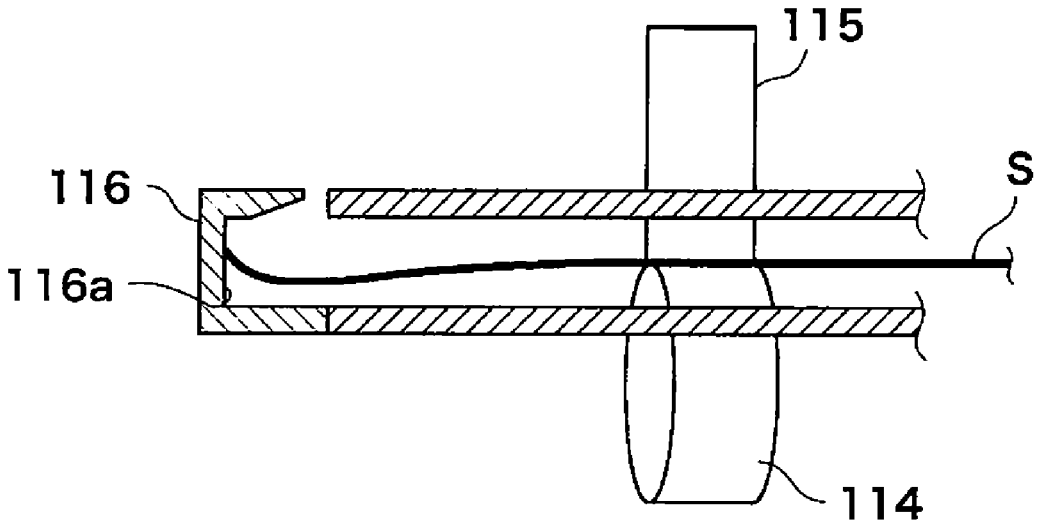

First, when the sheet S enters the image pickup area A as shown in FIG. 7A, the sheet sensor 117 detects the sheet. In response to the detection of the sheet by the sheet sensor 117, the image pickup device 131 of the skew sensor 130 picks up an image of the sheet S (an image of the sheet S in the image pickup area A). Based on the picked up image of the sheet S, a left edge 301 and a front edge 302 of the sheet S are recognized, and an angle formed between the left edge 301 and the front edge 302 of the sheet S is detected as the squareness $\alpha$. The detected squareness $\alpha$ of the sheet S is stored in the RAM 203. Usually, since the squareness of the sheet S varies due to cutting precision, if the squareness of the sheet S is a fixed angle (for example, $\pi/2$ (rad.)) and this is the target angle of the skew correction, it is conceivable that the precision of the skew correction decreases. Therefore, the above-mentioned squareness $\alpha$ is detected for every sheet S in this embodiment.

Figure 7B:
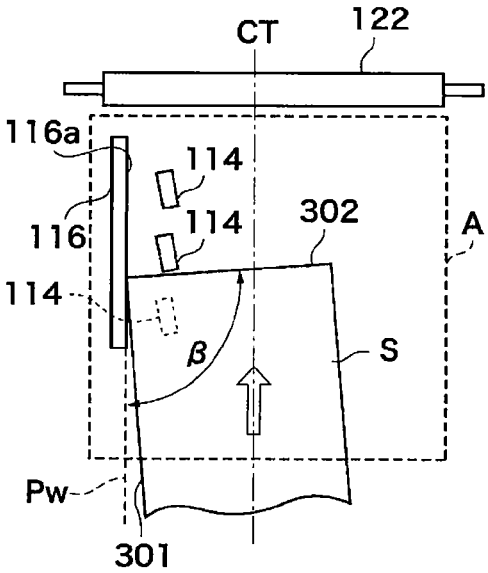

Subsequently, as shown in FIG. 7B, the sheet S is aslant conveyed by the diagonal feeding rollers 114 towards the contact reference member 116, and the sheet S contacts with the contact surface 116*a* of the contact reference member 116. Accordingly, the sheet S is conveyed so that the left edge 301 keeps contact with the contact surface 116*a* of the contact reference member 116. Images in the image pickup area A are continuously picked up by the image pickup device 131 during the conveyance of the sheet S. The angle formed between the contact surface 116*a* of the contact reference member 116 located at the standby position Pw (or the sheet conveyance reference position CT) and the front edge 302 of the sheet S is detected as the skew angle $\beta$ with respect to the conveyance direction X of the sheet S for every picked-up image of the sheet S. When the left edge 301 of the sheet S meets completely the contact surface 116*a* of the contact reference member 116, the above-mentioned skew angle $\beta$ is in agreement with the squareness $\alpha$ stored in the RAM 203. This means that the skew of the sheet S has been corrected. Thus, when the skew angle $\beta$ of the sheet S is detected and it is determined whether the skew angle $\beta$ is in agreement with the squareness $\alpha$, it is possible to determine whether the skew of the sheet S has been corrected or not.

When the left edge 301 of the sheet S meets completely the contact surface 116*a* of the contact reference member 116 and is inserted into the contact reference member 116, the left edge 301 of the sheet S cannot be recognized from the picked-up image of the sheet S. Therefore, in this embodiment, the front edge 302 of the sheet S is recognized, and the skew angle $\beta$ is detected from the front edge 302 of the sheet S, as mentioned above.

In this embodiment, as mentioned above, the values according to the thickness of the sheet (for example, a thin sheet with low stiffness or a thick sheet with high stiffness) are set to the control parameters P1 through P3. The thickness of the sheet is detected by a method of detecting the thickness of the sheet S based on an output of a well-known sheet thickness sensor, or a method of detecting the thickness of the sheet based on a sheet type (for example, a regular sheet, a thick sheet, a postcard, etc.) selected by a user, for example.

Initial values of the control parameters P1 through P3 corresponding to respective thicknesses of the sheet S are stored in the ROM 202. The ROM 202 stores the target change rate R of the skew angle $\beta$ per unit time ($R=\Delta\beta/\Delta t$) required for making the skew angle $\beta$ reach to the squareness with respect to the sheet S that has entered the skew correction section 110 with the skew angle $\beta$. The target change rate R is obtained under a condition where the skew of the sheet S has been completed before the front edge of the sheet S passes through the image pickup area A. The plurality of target change rates R are stored corresponding to the skew angles β, which are values when the sheets S enter the skew correction section 110, and the thicknesses of the sheets S. And the target change rate that corresponds to the skew angle β at the time when the sheet S enters the skew correction section 110 and the thickness of the sheet S is selected from among the plurality of target change rates R.

At the time of the skew correction, values (initial values) corresponding to the thickness of the sheet S are set up to the control parameters P1 through P3, and then, the diagonal feeding rollers 114 rotates in the conveyance nip pressure, the inclination angle of the rotation axes, and the conveyance speed that are specified based on the values of the control parameters P1 through P3. And the skew correction of the sheet S is started. At this time, the sheet sensor 117 detects the front edge of the sheet S that enters the skew correction section 110, and outputs a detection signal. In response to the output of this detection signal, one of the conveying roller pair 103 of the conveyance section 100 is released from the other in order not to inhibit the diagonal feeding of the sheet S by diagonal feeding rollers 114.

When starting the skew correction, the skew angle β of the sheet S is detected based on the image in the image pickup area A picked up by the image pickup device 131 (the image of the sheet S that enters the image pickup area A). Here, the skew angle β of the sheet S varies as the sheet S is conveyed (elapse of time), and this changing skew angle β is detected serially. And the change rate R' of the detected skew angle β per unit time ($R'=\Delta\beta/\Delta t$) is computed.

Subsequently, the target change rate R corresponding to the skew angle β at the time when the sheet S enters the skew correction section 110 and the thickness of the sheet S is read from the ROM 202, and the target change rate R is compared with the computed change rate R'. Here, when an absolute difference value ΔR ($=|R'-R|$) between the computed change rate R' and the corresponding target change rate R is not larger than a predetermined value ΔRth, the values set to the above-mentioned control parameters P1 through P3 are not changed.

On the other hand, when the above-mentioned absolute value ΔR is larger than the predetermined value ΔRth, the values set to the above-mentioned control parameters P1 through P3 are changed so that the computed change rate R' approaches or equals the corresponding target change rate R.

Thus, during the skew correction, the change rate R' of the skew angle β of the sheet S per unit time is computed serially, and the control to change at least one of the values of the control parameters P1 through P3 is performed so that the calculated change rate R' approaches or equals the corresponding target change rate R. Accordingly, since the skew angle β is in agreement with the squareness α before the front edge 302 of the sheet S passes through the image pickup area A, the skew correction of the sheet S is completed.

Figure 7C:
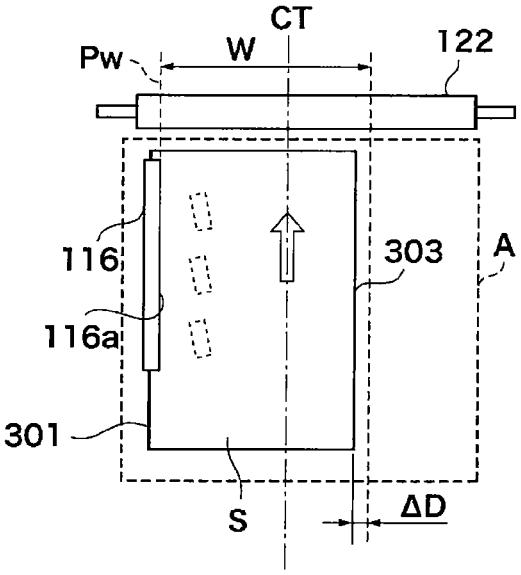

When the skew correction for the sheet S is finished (the skew angle β is in agreement with the squareness α), as shown in FIG. 7C, the sheet S is conveyed toward the registration roller pair 122 under a condition where the left edge 301 is in parallel to the contact surface 116*a* of the contact reference member 116. At this time, the position of the right edge 303 of the sheet S is determined based on the image in the image pickup area A picked up by the image pickup device 131 of the skew sensor 130. The position of the right edge 303 of this detected sheet S is detected with respect to the position Pw of the contact surface 116*a* of the contact reference member 116.

Here, since the left edge of the sheet S contacts with the contact surface 116*a* during the skew correction, a neighborhood of the contact surface 116*a* of the sheet S may be buckled in the width direction Y as shown in FIG. 8A, for example, when the stiffness of the sheet S is low. As shown in FIG. 8B, for example, when the left edge of the sheet S has curled greatly, a buckling may occur similarly.

Thus, when a buckling occurs in the sheet S, the detected position of the right edge 303 will be shifted by the deviation amount ΔD toward the contact reference member 116 with respect to the position corresponding to the length W of the sheet S in the width direction Y (a length specified by a nominal size of the sheet S). This deviation amount ΔD is a difference between a length from the position Pw of the contact surface 116*a* to the detected position of the right edge of the sheet S and the length W of the sheet S in the width direction Y, and is generated by the buckling of the sheet S. When the above-mentioned buckling has not occurred, the detected position of the right edge 303 is coincident with the position corresponding to the above-mentioned length W, and the deviation amount ΔD becomes "0". Therefore, the above-mentioned deviation amount ΔD is computed based on the detected position of the right edge 303 and the position corresponding to the length W of the sheet S in the width direction Y.

In this embodiment, a length specified by a nominal size of the sheet S (for example, 297 mm in a case of A4 landscape feeding, 210 mm in a case of A4 portrait feeding) is used as the length W of the sheet S in the width direction Y. This length is stored in the ROM 202. Instead of this, the length in the width direction Y of the sheet S without a buckling may be calculated based on the positions of the left edge 301 and the right edge 303 that are detected in the stage in FIG. 7A.

Figure 7D:
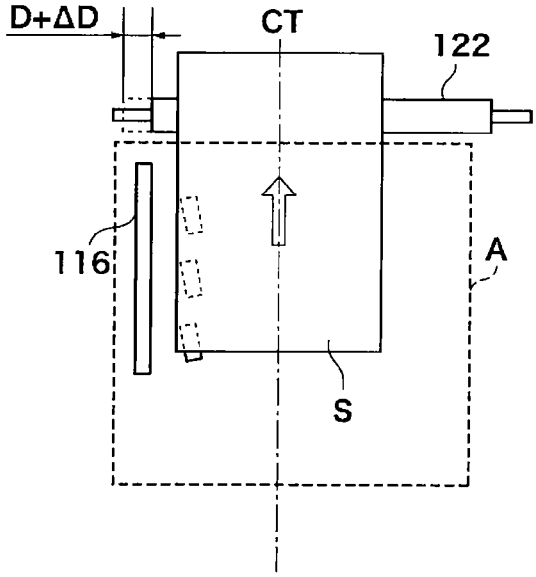

Thus, when the deviation amount ΔD is generated due to the buckling, the position of the sheet S is deviated from the image reference position of the above-mentioned secondary transfer position. The misalignment of the sheet S after the skew correction is corrected by the movement of the registration roller pair 122 as shown in FIG. 7D. Here, the moving amount of the registration roller pair 122 is determined as an amount (D+ΔD) by adding the deviation amount ΔD to the above-mentioned contact margin D.

When the sheet S is nipped and conveyed by the registration roller pair 122, the registration roller pair 122 is moved by the determined moving amount (D+ΔD) in the width direction Y. At this time, the driven rollers 115 corresponding to the diagonal feeding rollers 114 are released in order not to inhibit the movement of the registration roller pair 122.

Accordingly, the misalignment of the sheet S by the deviation amount ΔD, which is generated due to the buckling of the sheet S after the skew correction, is corrected. And the position of the sheet S after the skew correction is accurately aligned with the image reference position.

Figure 9:
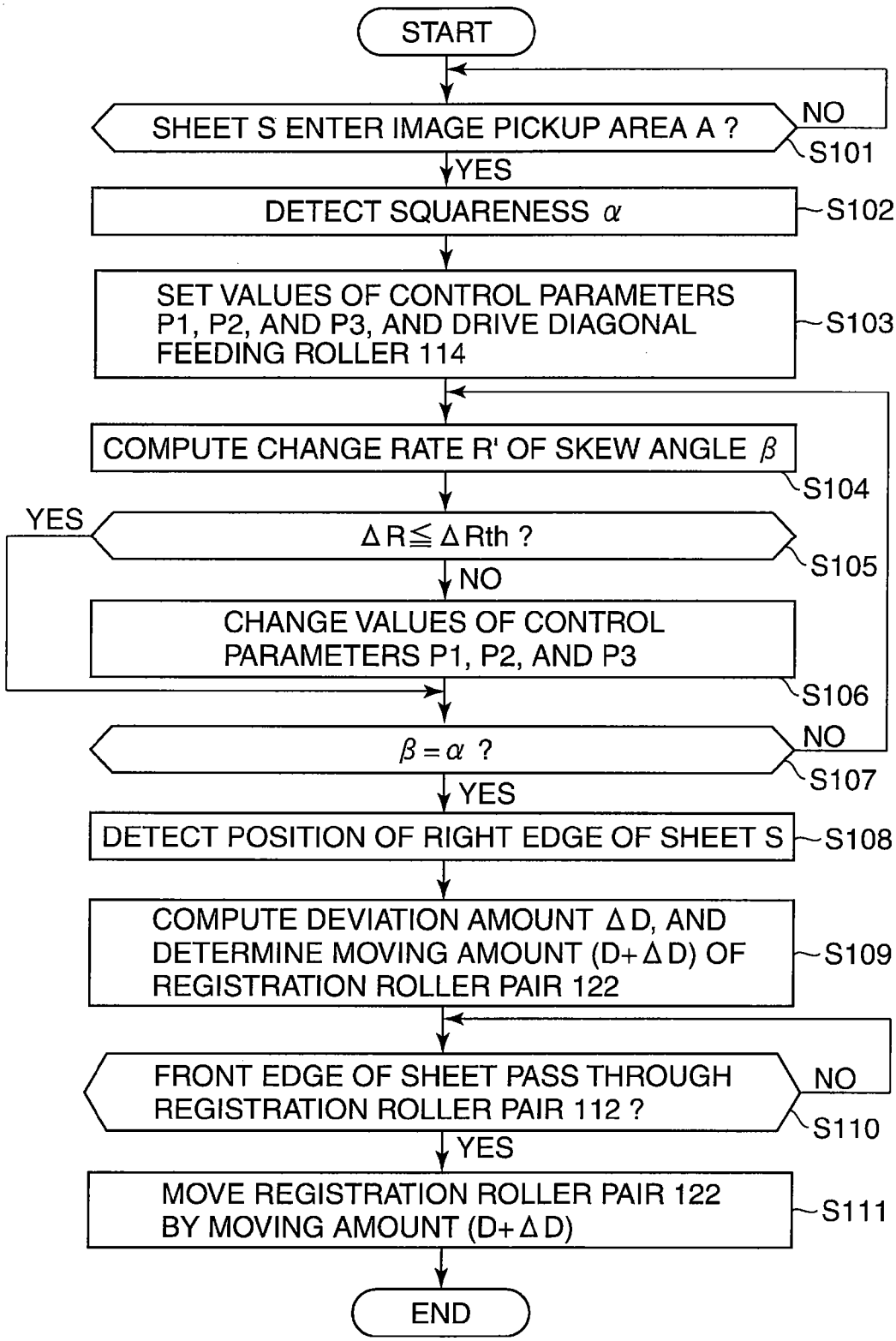
FIG. 9 is a flowchart showing procedures to control the registration unit by the control unit in FIG. 6.
Figure 10:
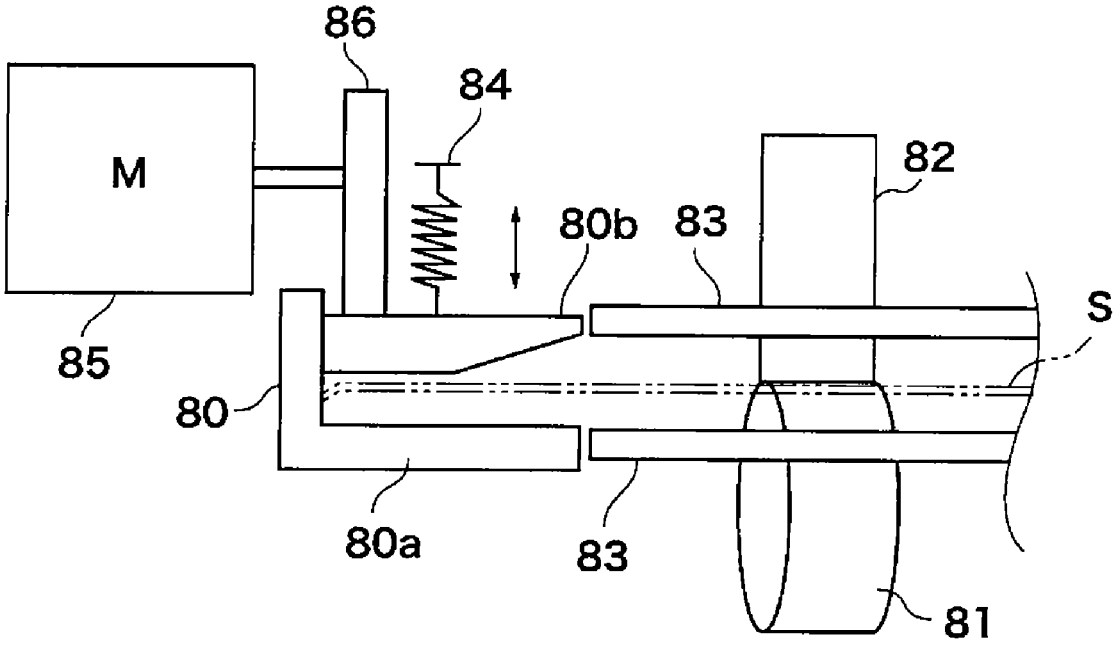
FIG.10 PRIOR ART
FIG. 10 is a longitudinal sectional view schematically showing a principal configuration of a sheet correction unit of a conventional sheet conveyance device.

Next, a control to the registration unit 13 by the control unit 200 will be described with reference to FIG. 9. FIG. 9 is a flowchart showing procedures to control the registration unit 13 by the control unit 200 in FIG. 6. The procedures shown in the flowchart in FIG. 9 are executed by the CPU 201 according to the program stored in the ROM 202.

The control unit 200 (the CPU 201) waits until the sheet S enters the image pickup area A (step S101) as shown in FIG. 9. Here, the control unit 200 determines whether the sheet S enters the image pickup area A based on the detection signal from the sheet sensor 117. When the sheet S enters the image pickup area A, the control unit 200 detects an angle formed between a left edge and a front edge of the sheet S (i.e., the squareness α) (step S102) based on an image of the sheet S (an image of the sheet S in the image pickup area A) that is picked up by the image pickup device 131 of the skew sensor 130. The detected squareness α of the sheet S is stored in the RAM 203.

Subsequently, the control unit 200 sets up the values (the initial values) of the control parameters P1 through P3 corresponding to the diagonal feeding roller contact mechanism 208, the diagonal-feeding-roller-skew-angle adjustment mechanism 207, and the diagonal feeding roller drive mechanism 206, respectively, and drives to rotate the diagonal feeding rollers 114 (step S103). And then, the control unit 200 computes the change rate R' of the skew angle β per unit time ($R'=\Delta\beta/\Delta t$) based on the image of the sheet S picked up by the image pickup device 131 (step S104). Here, the control unit 200 computes the change rate R' of the skew angle β during a predetermined period based on images of the sheet S that are continuously picked up by the image pickup device 131 during the predetermined period.

Subsequently, the control unit 200 determines whether the absolute difference value ΔR ($=|R'-R|$) between the computed change rate R' and the corresponding target change rate R is equal to or smaller than the predetermined value ΔRth (step S105). When the above-mentioned absolute value ΔR is larger than the predetermined value ΔRth, the control unit 200 changes the values of the above-mentioned control parameters P1 through P3 so that the computed change rate R' approaches or equals the corresponding target change rate R (step S106). And the control unit 200 determines whether the detected skew angle β is coincident with the squareness α (step S107). When the detected skew angle β is not coincident with the squareness α, the control unit 200 determines that the skew correction of the sheet S is not completed, and returns the process to the step S104.

When determining that the absolute difference value ΔR is equal to or smaller than the predetermined value ΔRth in the step S105, the control unit 200 determines whether the detected skew angle β is coincident with the squareness α (step S107) without changing the values of the above-mentioned control parameters P1 through P3. When the detected skew angle β is not coincident with the squareness α, the control unit 200 returns the process to the step S104.

When it is determined that the detected skew angle β is coincident with the squareness α in the step S107, the control unit 200 determines that the skew correction of the sheet S is completed. In this case, the control unit 200 detects the position of the right edge of the sheet S with respect to the standby position Pw of the contact reference member 116 based on the image in the image pickup area A picked up by the image pickup device 131 (step S108). The control unit 200 computes the deviation amount ΔD based on the detected position of the right edge of the sheet S and the length W of the sheet S in the width direction Y specified by the nominal size of the sheet S, and determines the moving amount (D+ΔD) of the registration roller pair 122 (step S109).

Subsequently, the control unit 200 waits until the front edge of the sheet S passes through the registration roller pair 122 (step S110). Here, the control unit 200 determines whether the front edge of the sheet S passes through the registration roller pair 122 based on a detection signal from the sheet sensor 124. When the front edge of the sheet S passes through the registration roller pair 122, the control unit 200 moves the registration roller pair 122 by the determined moving amount (D+ΔD) in the width direction Y (step S111). At this time, the registration roller pair 122 is in a condition where it nips and conveys the sheet S.

Thus, in this embodiment, since the cross sectional shape of the contact reference member 116 is a united shape having a groove, there is a extremely low possibility to cause a jam when the left edge of the sheet S is inserted into the contact reference member 116. Therefore, a generation of a jam in the skew correction section 110 can be reduced.

Even if the buckling of the sheet S occurs when the left edge of the sheet S contacts with the contact surface 116*a* of the contact reference member 116, the deviation amount of the position of the sheet S from the image reference position due to the buckling is added to the moving amount of the registration roller pair 122. Accordingly, the misalignment of the sheet S due to the generation of the buckling can be corrected certainly.

The skew angle β of the sheet S and the positions of the right and left edges of the sheet S, which vary in time, are easily and correctly detectable by the skew sensor 130 that picks up an image of the sheet S. It should be noted that the side edge position of the sheet S can be detected by a line sensor provided separately instead of using the image pickup device of the skew sensor 130. As mentioned above, the completion of the skew correction may be determined by detecting whether the front edge of the sheet S becomes perpendicular to the conveyance direction, without finding the squareness α of the sheet. In this case, an image pickup device of which an image pickup area is smaller than the image pickup area A shown in FIG. 2 is enough to be used.

Although the image forming apparatus of the electrophotography method has been described in this embodiment, the principle of the present invention is applicable to image forming apparatuses of other methods such as an inkjet method, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-113539, filed May 8, 2009, which is hereby incorporated by reference herein in its entirety.

What is claimed is:

1. An image forming apparatus comprising:

a conveying unit adapted to convey a sheet;

a reference member, arranged in parallel to a conveyance direction of the sheet by said conveying unit, to which one of side edges of the sheet contacts;

a feeding unit adapted to feed the sheet diagonally with respect to the conveyance direction of the sheet such that the one of side edges of the sheet conveyed by said conveying unit contacts to said reference member;

an image pickup unit adapted to pick up an image of the sheet fed by said feeding unit;

a first moving unit adapted to move said reference member in a width direction of the sheet perpendicular to the conveyance direction of the sheet;

a second moving unit adapted to move the sheet in the width direction; and a control unit adapted to perform skew correction of the sheet and perform misalignment correction of the sheet in the width direction, wherein said control unit controls said first moving unit to move said reference member in the width direction based on a size of the sheet with respect to the width direction;

determines whether or not skew of a front edge of the sheet is corrected based on an output of said pickup unit while the feeding unit is feeding the sheet with the one of the side edges of the sheet contacting to said reference member;

detects a position of the other of the side edges of the sheet with respect to the width direction based on the output of the image pickup unit, when it is determined that the front edge of the sheet has been corrected; and controls said second moving unit to move the sheet based on a difference between the detected position of the other of the side edges of the sheet and a specified position determined based on the size of the sheet.

2. The image forming apparatus according to claim 1, wherein said control unit computes a length from a position of the reference member to the position of the other of the side edges of the sheet, and determines a moving amount based on a difference between the computed length and the length of the sheet in the width direction.

3. The image forming apparatus according to claim 1, wherein a length specified by a nominal size of the sheet is used as the length of the sheet in the width direction.

4. The image forming apparatus according to claim 1, wherein said control unit detects an angle formed between the front edge and the side edge of the sheet as a squareness based on the output of said image pickup unit;

detects an angle of the front edge of the sheet with respect to the conveyance direction as the skew angle of the sheet based on the output of said image pickup unit; and detects the position of the other of the side edges of the sheet with respect to the position of the reference member when the detected skew angle of the sheet is coincident with the detected squareness of the sheet.

5. The image forming apparatus according to claim 4, wherein said control unit computes a change rate of the skew angle of the sheet detected and to change a value of a control parameter for controlling of said feeding unit so that the change rate of the skew angle approaches a predetermined target change rate.

* * * * *